United States Patent [19]

Petrie et al.

[11] Patent Number: 4,764,840

[45] Date of Patent: Aug. 16, 1988

[54] DUAL LIMIT SOLENOID DRIVER CONTROL CIRCUIT

[75] Inventors: Adelore F. Petrie, Arlington Heights; Thomas F. Karlmann, Schaumburg; Steven G. Parmelee, Algonquin; Arthur J. Edwards, Hoffman Estates, all of Ill.

[73] Assignee: Motorola, Inc., Schaumburg, Ill.

[21] Appl. No.: 911,946

[22] Filed: Sep. 26, 1986

[51] Int. Cl.[4] ..... H01H 47/32; F02D 41/30

[52] U.S. Cl. ..... 361/154; 123/490

[58] Field of Search ..... 361/152, 153, 154; 123/490

[56] References Cited

U.S. PATENT DOCUMENTS

| | | | |
|---|---|---|---|
| 4,266,261 | 5/1981 | Streit et al. | 361/154 |
| 4,295,177 | 10/1981 | Woodhouse et al. | 361/154 |
| 4,300,508 | 11/1981 | Streit et al. | 123/490 |
| 4,605,983 | 8/1986 | Harvey | 361/154 |

*Primary Examiner*—L. T. Hix
*Assistant Examiner*—David M. Gray
*Attorney, Agent, or Firm*—Phillip H. Melamed

[57] ABSTRACT

An improved dual limit solenoid driver control circuit is disclosed in which solenoid current is sensed and provided as an input to two separate comparators (24, 25). Each comparator receives, during a solenoid pull-in (initial) period ($T_1$), fixed maximum and minimum reference threshold levels which determine the maximum and minimum current limits ($I_{max}$, $I_{min}$) for solenoid current during initial pull-in excitation. Subsequently during a hold period $T_2$ following the pull-in period, each of the comparators receives different maximum and minimum thresholds so as to establish holding solenoid current limits ($H_{max}$, $H_{min}$). The outputs of the compartors are connected as inputs to a set/reset flip flop (32) whose output controls the operation of a solenoid driver circuit (15). A monostable multivibrator (33) reacts to an initial control pulse (41) to produce a predetermined pull-in time pulse (43) that results in the maximum and minimum pull-in solenoid current limits. The comparator thresholds are provided by a fixed resistor divider circuit (27, 29, 31) which receives a pull-in signal from the monostable multivibrator. The pull-in period ($T_1$) is independent of the sensed solenoid current, and the switching thresholds are fixed and independent of the magnitude of the solenoid current during the pull-in and hold periods. The above configuration provides improved performance and stability, and is readily implemented with just a few components.

15 Claims, 2 Drawing Sheets

DUAL LIMIT SOLENOID DRIVER CONTROL CIRCUIT

BACKGROUND OF THE INVENTION

The present invention is related to inductor current controllers, and more specifically to solenoid current controllers.

It is known that it is generally desirable to implement actuation of a solenoid by providing an initial or pull-in period of time during which a maximum first current is effectively passed through the solenoid inductor to achieve initial actuation of the solenoid. Subsequently, a smaller magnitude solenoid current is implemented so as to maintain actuation of the solenoid wherein this occurs during a subsequent holding or hold period of time. In this manner, the efficiency of the solenoid controller is increased since only the minimum necessary holding current is utilized by the solenoid for maintaining solenoid actuation whereas a high pull-in or actuation current is initially permitted to insure the rapid response of the solenoid to a solenoid actuation control pulse.

Many prior circuits have implemented the general features of the solenoid current control system discussed above. Some of these systems determine the pull-in time, during which a high value of solenoid current can be drawn, by use of a monostable multivibrator. These systems typically utilize additional monostable multivibrators for implementing cycling of the solenoid current about a first high pull-in level and then about a low holding current level. This cycling is implemented by essentially opening and closing the connection between the solenoid coil and a power supply such that during the pull-in period solenoid current varies between maximum and minimum initial high current levels, and during the holding current period solenoid current varies maximum and minimum lower holding current levels. However, the prior systems which utilize monostable multivibrators for determining when such cycling is to occur between the maximum and minimum current levels are not believed to be sufficiently accurate. This is because there is no direct control of the maximum/minimum current levels of the solenoid current, and therefore other circuit parameters can substantially affect the actual solenoid current level regardless of the accuracy of the monostable multivibrators.

While some prior systems have sensed solenoid current directly and have utilized comparators which react to both the sensed solenoid current and current limit reference thresholds so as to control the variation of solenoid current, typically these systems utilize hysteresis to implement the desired switching between maximum and minimum current levels. This use of hysteresis can present stability problems due to temperature variation of the feedback gain which implements the hysteresis. In addition, the use of hysteresis generally results in the reference threshold levels being a function of the sensed solenoid current, and this again is not believed to be a desirable result. Circuit stability would be enhanced if reference thresholds for comparators are fixed during critical operating cycles. In addition, in some systems the pull-in period of time during which a relatively high current for the solenoid is permitted is a function of the sensed solenoid current, and this can lead to variable circuit performance which would be undesired.

In addition to the above disadvantages of prior circuits, typically the circuitry required for implementation of such prior systems is relatively complex, and circuit design flexibility enabling the selection of different maximum and minimum current limits during the pull-in and hold periods is difficult to achieve.

SUMMARY OF THE PRESENT INVENTION

An object of the present invention is to provide an improved solenoid driver control circuit which overcomes the above-noted deficiencies of prior circuits.

In one embodiment of the present invention, an improved solenoid driver control circuit is provided. The control circuit comprises: a control signal input terminal for receiving a control signal; current sense means for providing a current sense signal indicative of current flowing through a solenoid; solenoid driver means having a first operable state such that current can flow through said solenoid from a power source and a second operable state such that current effectively cannot flow from said power source through said solenoid; two separate threshold comparator means, each for comparing at least one received reference threshold input signal with said current sense signal and each for providing an output signal in response thereto to control said solenoid driver means; pull-in current means for responding to said control signal by initially providing, for a predetermined pull-in period of time independent of said current sense signal, a pair of predetermined maximum and minimum first thresholds, each of said separate threshold comparator means receiving an associated one of said pair of maximum and minimum first thresholds, said pair of first thresholds causing said comparator means to implement pull-in maximum and minimum current limits for said solenoid current during said predetermined pull-in period of time; and holding current means for providing, for a hold time after said predetermined pull-in period of time, a pair of predetermined maximum and minimum second thresholds, each of said separate threshold comparator means receiving an associated one of said second thresholds during said hold time rather than said first thresholds, wherein during said hold time said pair of second thresholds define hold cycle maximum and minimum current limits for said solenoid current during said hold time.

Preferably in the solenoid driver control circuit recited above, the switching thresholds are fixed and independent of the magnitude of solenoid current during the pull-in and hold periods of time. In addition, the maximum first threshold exceeds the maximum second threshold and similarly the minimum first threshold exceeds the minimum second threshold. Preferably, the outputs of the two threshold comparators are provided as effective inputs to the set and reset terminals of a flip flop circuit whose output provides a signal to control the solenoid driver means. An effective implementation of the solenoid driver control circuit discussed above is provided by the use of a monostable multivibrator which responds to the control signal at the input terminal and produces an output pulse, defining the pull-in period, which is then coupled as an input to a resistor divider circuit which provides the maximum and minimum thresholds to each of the separate comparators. This circuit configuration can be readily implemented in an integrated circuit design and has improved stability and performance characteristics with respect to previous circuit implementations, as well as providing circuit design flexibility to set the pull-in and hold thresholds.

BRIEF DESCRIPTION OF THE DRAWINGS

For a more complete understanding of the present invention, reference should be made to the drawings in which.

DESCRIPTION OF THE PREFERRED EMBODIMENT

Figure 1:
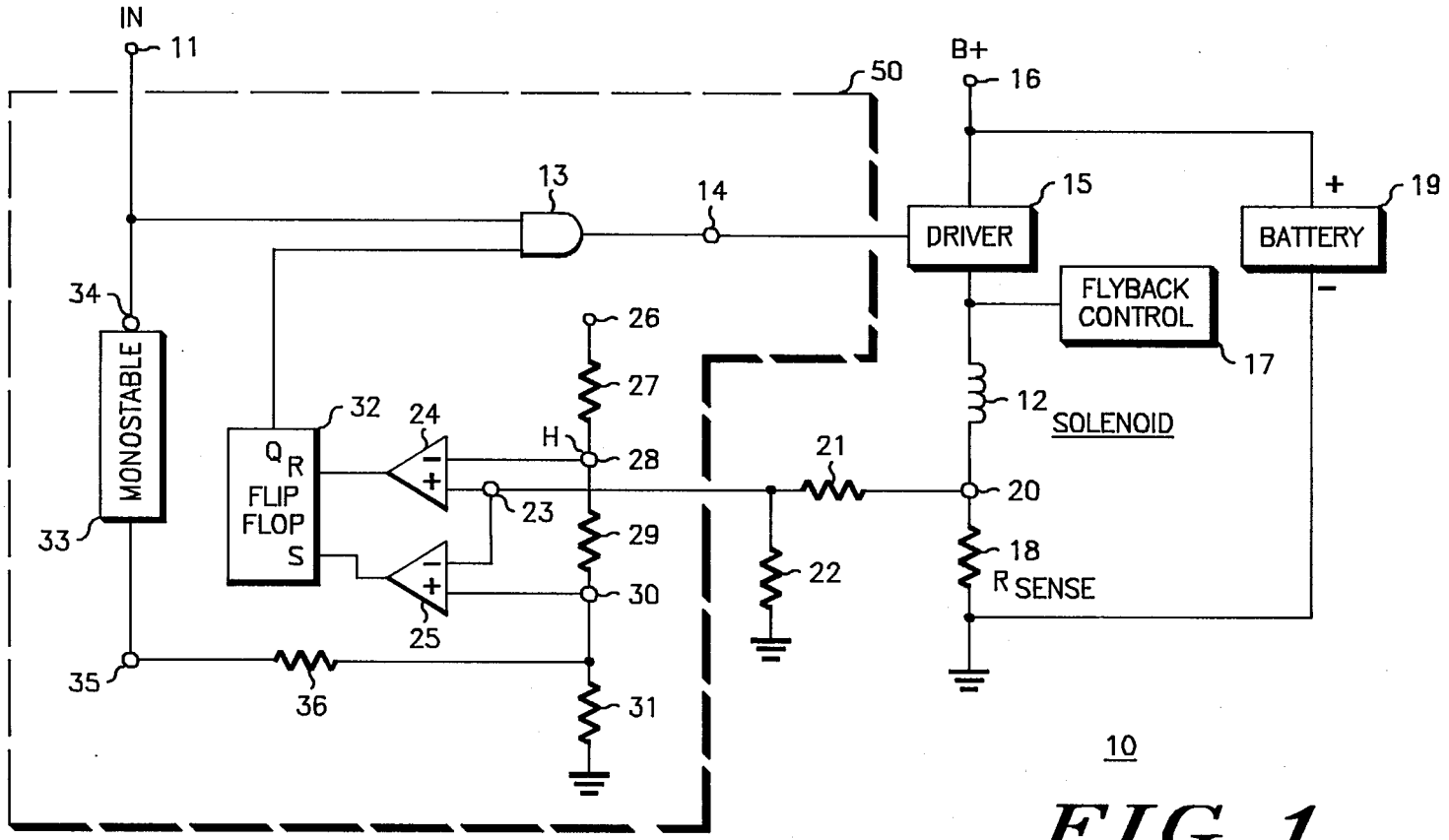
FIG. 1 is a schematic diagram of a dual limit solenoid current controller circuit constructed in accordance with the present invention.

Referring to FIG. 1, a dual limit solenoid current controller circuit 10 is illustrated. The circuit includes an input terminal 11 at which a control signal is received wherein actuation of a solenoid 12, illustrated in FIG. 1 by a solenoid inductance 12, is implemented in response to the control signal.

The terminal 11 is connected as an input to an effective AND gate 13 which provides an output at a terminal 14 that is coupled as an input to a solenoid driver stage 15 connected between a positive battery voltage terminal 16 and the solenoid inductor 12. A flyback control device 17 is also connected to the solenoid 12 so as to implement flyback voltage control for energy stored in the solenoid inductor. The solenoid 12 is connected through a current sensing resistor 18 to ground potential, and a power source comprising a battery 19 is connected between the terminal 16 and ground potential.

Essentially, signals at the terminal 14 switch the solenoid driver stage 15 on and off such that when the driver stage 15 is on, current can flow through the solenoid inductor 12 from the power source battery 19, and when the driver stage 15 is off, current cannot effectively flow through the solenoid from the power source. The operation of the flyback control device 17 to recirculate current produced by energy stored in the solenoid is well understood to those of skill in the art and, therefore, will not be further explained.

The connection between the solenoid 12 and the sensing resistor 18 is provided at a terminal 20 that is coupled through a calibration resistor divider network comprising resistors 21 and 22 to a terminal 23. The terminal 23 is directly connected to the noninverting input of a DC comparator 24 and to the inverting input of a DC comparator 25. The DC comparators 24 and 25 are substantially identical in construction. A resistor divider network is provided between a low voltage power supply terminal 26 and ground potential wherein a resistor 27 is connected between the terminal 26 and a terminal 28 corresponding to the inverting input of the comparator 24. A resistor 29 is connected between the terminal 28 and a terminal 30 corresponding to the noninverting input of the comparator 25. A resistor 31 is connected between the terminal 30 and ground potential. The resistor divider comprising the resistors 27, 29 and 31 will essentially selectively provide maximum and minimum first and second threshold levels to the comparators 24 and 25 in accordance with the present invention as will be subsequently discussed.

The output of the comparator 24 is connected to a reset terminal R of a set/reset flip flop circuit 32, and the output of the comparator 25 is connected to a set terminal S of the flip flop. An output terminal Q of the flip flop 32 is connected as an input to the AND gate 13. A monostable multivibrator 33 has an input terminal 34 directly connected to the terminal 11 and provides an output signal at a terminal 35. The terminal 35 and the signal thereat are coupled through a scaling resistor 36 to the terminal 30. The operation of the above-noted circuit configuration will now be discussed in conjunction with the circuit waveforms shown in FIG. 2 wherein the vertical axis of these waveforms represents magnitude and the horizontal axis is representative of time.

Figure 2:
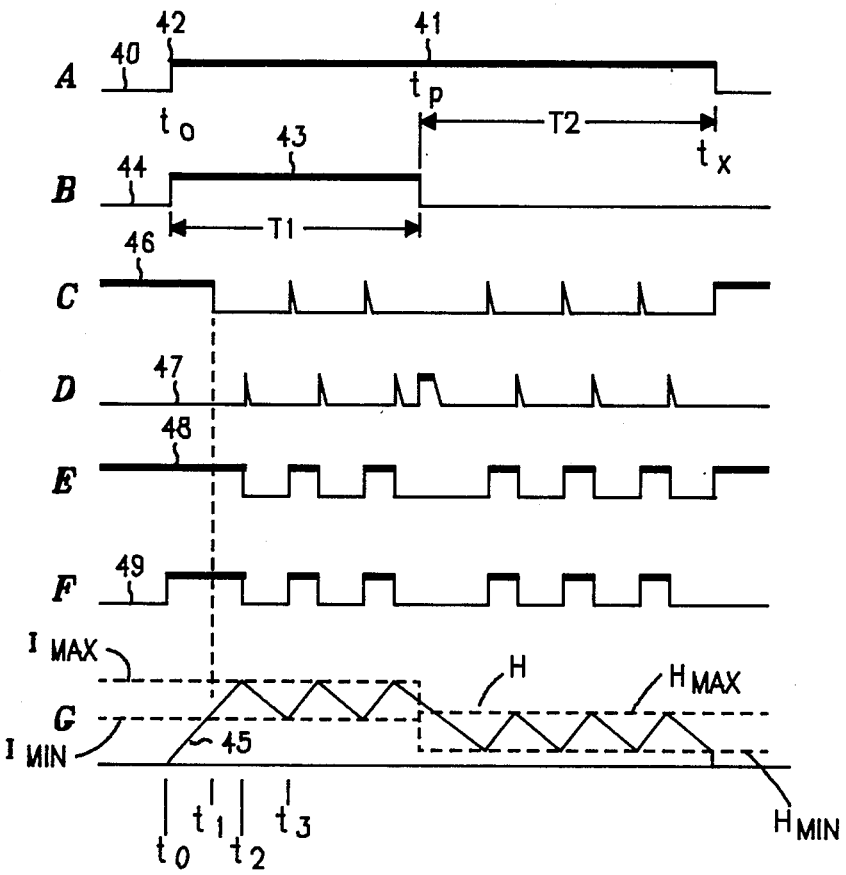
FIG. 2 is a series of graphs A through G which illustrate signal waveforms provided at various terminals of the circuit shown in FIG. 1.

Graph A in FIG. 2 represents a control signal 40 provided at the input terminal 11 of the system shown in FIG. 1. Prior to an initial time $t_0$, a low signal level is present which results in the driver stage 15 preventing current flow from the battery 19 through the solenoid 12. In other words, the driver stage 15 represents an open circuit so as to prevent solenoid current flow. At the time $t_0$, a positive pulse 41 of predetermined length commences for the signal 40 wherein during this pulse, actuation of the solenoid 12 is desired. In response to a leading edge 42 of this positive pulse of the signal 40, the monostable multivibrator 33 produces an output pulse 43 of a signal 44 having a predetermined time duration T1 corresponding to a "pull-in" time period. During this pull-in time period, an effective relatively high current is allowed to flow in the solenoid 12 to insure rapid actuation of the solenoid. Subsequently during a hold period T2, a lower current level will effectively be provided for the solenoid 12 so as to maintain the solenoid in an actuated state. This is accomplished in the following manner.

Essentially, the monostable 33 produces the output pulse 43 which, via the scaling resistor 36, produces a voltage pulse at the terminal 30. The signal 44 is schematically represented by the graph B in FIG. 2. Graph G in FIG. 2 is representative of the voltage at the terminal 20 which essentially corresponds to a current sense signal 45. At the time $t_0$, there is no current flowing in the solenoid 12, and, therefore, the voltage at the terminal 20 representative of sensed solenoid current, which is sensed by the resistor 18, is 0. Since a low voltage is provided at the terminal 20 prior to $t_0$, this results in the comparator 25 producing a high output setting flip flop 32 since the voltage at the terminal 30 will exceed the current sense related signal provided at the terminal 23. The output of the comparator 25 corresponds to a signal 46 illustrated in graph C in FIG. 2. Since the voltage at the terminal 23 is low (zero) at the time $t_0$, this results in the comparator 24 providing a low output at this time to the reset terminal R of the flip flop 32. The output of the comparator 24 is illustrated in graph D of FIG. 2 as signal 47. The end result is that at the time $t_0$, the flip flop 32 will be set such that the signal at its output terminal Q will be high wherein this signal corresponds to the signal 48 illustrated in graph E in FIG. 2. Since the signal 48 provides one input to the AND gate 13, and the signal 40 at the terminal 11 provides the other input, this results in the output of the AND gate 13, at terminal 14, switching from low to high at the time $t_0$. The signal at the terminal 14 is illustrated in graph F of FIG. 2 as the signal 49. The end result is that a high signal is provided as an input to the driver stage 15 via the terminal 14. This results in effectively closing a switch in stage 15 which connects the battery 19 to the solenoid 12 and results in the initiation of solenoid current such that the current sense signal 45 will begin to rise after $t_0$. As the current through the solenoid rises, the voltage at the terminal 23 will increase wherein this voltage varies in substantially the same manner as the signal 45 at the terminal 20.

During the pull-in period corresponding to the period T1, the output of the monostable multivibrator 33 results in predetermined fixed reference voltages being provided at the terminals 28 and 30 wherein these voltages comprise reference threshold voltages applied to the separate comparators 24 and 25. As the voltage at the terminal 20 increases, the signal at the terminal 23 will essentially pass the fixed reference voltage being maintained at the terminal 30, and this will result in the signal 46 at the set terminal S of the flip flop going low. This occurs at $t_1$. However, this has no effect on circuit operations since the output 48 of the flip flop 32 remains in a high state. This is readily visualized in graph G in FIG. 2 by the signal 45 exceeding a reference current level corresponding to an initial minimum level $I_{min}$.

Subsequently, the solenoid current represented by the signal 45 will continue to increase until an initial maximum reference level $I_{max}$ is achieved at a time $t_2$ at which time the comparator 24 will produce an output pulse since the voltage at the terminal 23 will now exceed the voltage at the reference terminal 28. In response to the output pulse produced by the comparator 24, the flip flop 32 will be reset such that its output 48 will be a low state, and this results in essentially opening the connection between the battery 19 and the solenoid 12. At this time, the flyback control device 17 implements control of the current recirculation maintained by the solenoid inductance, and solenoid current begins to decrease as is generally illustrated by the reduction in the signal 45 shown in graph G. This reduction in solenoid current continues until such time $t_3$ as the voltage at the sense terminal 23 is such that the reference threshold voltage at the terminal 30 now exceeds the voltage at the terminal 23. At this time, the comparator 25 will produce a brief output pulse resulting in setting the flip flop 32 to a high state, and this results in closing the connection between the battery and the solenoid so as to increase solenoid current. This type of operation continues cyclically until the end of the pull-in period T1 which occurs at a time $t_p$. Thus, during the pull-in period of time $T_1$, the solenoid current will effectively cyclically vary between reference thresholds corresponding to the pull-in current reference levels $I_{max}$ and $I_{min}$ shown in graph G.

During the hold period time $T_2$ which exists from the time $t_p$ to the end of the control pulse 41 of the signal 40, which terminates at a subsequent time $t_x$, the monostable 33 ceases to provide any voltage pulse to the terminal 30. This results in changing the fixed thresholds which are present at the terminals 28 and 30 of the resistor divider of the present circuit which divider comprises the resistors 27, 29 and 31. The effect of this is to implement holding maximum and holding minimum current thresholds $H_{max}$ and $H_{min}$ for the solenoid current wherein these levels are generally illustrated in graph G of FIG. 2. Thus during the holding period, again the solenoid current will vary cyclically due to the operation of the comparators 24 and 25, but now the maximum and minimum holding thresholds for solenoid current are lower than the corresponding maximum and minimum solenoid current threshold levels provided during the initial pull-in period. It should be noted that the maximum and minimum reference threshold levels for both the pull-in period and the hold period are provided at the terminals 28 and 30 wherein during the pull-in period higher fixed levels are provided due to the operation of the monostable multivibrator 33, whereas during the hold period lower fixed threshold levels are provided.

As can be seen from the above description of the present invention, a solenoid driver control circuit, as shown in FIG. 1, has been provided. The control circuit includes the control terminal 11 at which the control signal 40 is provided, as well as the current sensing resistor 18 that produces the sense signals at the terminals 20 and 23 that are representative of current flowing through the solenoid 12. The solenoid driver stage 15 is essentially operable in first and second states such that in on and off conditions it will selectively connect and disconnect the battery power source 19 to the solenoid 12. Two separate threshold comparators 24 and 25 are provided with each of these comparing at least one received fixed reference threshold input signal, provided by the voltage divider comprising the resistors 27, 29 and 31, with a current sense signal representative of the voltage at the terminal 23. The outputs of each of these comparators are coupled through the flip flop 32 so as to provide control of the solenoid driver stage 15.

The present invention has provided an effective pull-in current means, which includes the monostable 33, that responds to the control signal at the terminal 11 for providing a predetermined pull-in period of time which is independent of the magnitude of the sensed solenoid current. Thus variations in solenoid current do not change the pull-in period of time. The present pull-in current means essentially provides initial maximum and minimum first fixed reference thresholds to each of the comparators 24 and 25 wherein these thresholds are also independent of the sensed solenoid current. The effect of this is to cause the comparators 24 and 25 to implement pull-in or initial maximum and minimum current limits for the solenoid current during the predetermined pull-in period of time $T_1$.

The present invention has also provided a holding current means which essentially corresponds to the operation of the resistor divider, comprising the resistors 27, 29 and 31, in the absence of the existence of the output pulse produced by the monostable 33 during the pull-in time period. This holding current means will essentially implement a predetermined pair of maximum/minimum second fixed reference thresholds corresponding to the holding current maximum and minimum thresholds illustrated in graph G in FIG. 2 during the hold time period $T_2$. During the hold time, the second thresholds, rather than the first thresholds, are provided as inputs to the comparators 24 and 25 wherein the second thresholds define the hold cycle maximum and minimum current limits for the solenoid current during the hold time period.

A feature of the present invention is that the switching thresholds during the pull-in time and the hold time are each fixed and independent of the magnitude of the solenoid current. Many prior systems do not have this feature and, therefore, suffer from stability problems since variations in solenoid current will cause variations in the reference threshold voltages applied to the comparators 24 and 25 which are responsible for accurately determining the current switching thresholds. In addition, the present invention provides both the maximum and minimum thresholds of the cycling of the solenoid current during the pull-in period, as well as the maximum and minimum thresholds of cycling of the solenoid current during the holding period, and this is accomplished with a minimum number of components since pairs of maximum and minimum thresholds are readily provided by a single voltage divider by virtue of only a single additional connection to the voltage divider via the monostable 33 and resistor 36.

Proper design of the control circuit of the present invention enables the selection of totally different maximum and minimum thresholds for the pull-in and holding periods of time with the maximum pull-in threshold exceeding the maximum holding reference threshold and the minimum pull-in reference threshold exceeding the minimum holding reference threshold. Many prior systems do not have this circuit design flexibility since they cannot readily provide four different reference thresholds without extensive circuit redesign, and typically prior systems do not suggest the desirability of providing this design flexibility. In addition, many of the components noted in the present control circuit can be readily implemented on an integrated circuit, shown dashed as component 50 in FIG. 1, and it is apparent that the present invention provides for a simplified implementation of the desired cyclic variation of solenoid current during the pull-in and holding periods of time.

While specific embodiments of the present invention have been shown and described, further modifications and improvements will occur to those skilled in the art. One such modification could comprise connecting the resistor 36 between terminals 35 and 28, instead of terminals 35 and 30. All such modifications which retain the basic underlying principles disclosed and claimed herein are within the scope of this invention.

We claim:

1. A solenoid driver control circuit comprising:

a control signal input terminal for receiving a control signal;

current sense means for providing a current sense signal indicative of current flowing through a solenoid;

solenoid driver means having a first operable state such that current can flow through said solenoid from a power source and a second operable state such that current effectively cannot flow from said power source through said solenoid;

two separate threshold comparator means, each coupled to said current sense means for comparing at least one received reference threshold input signal with said current sense signal and each for providing an output signal in response thereto to control said solenoid driver means;

means coupling said output signals of said two comparator means to said solenoid driver means for, in response to said output signals of said comparator means, controlling the operable states of said driver means;

pull-in current means coupled between said control input terminal and said comparator means for responding to said control signal by initially providing, for a predetermined pull-in period of time independent of said current sense signal, a pair of predetermined maximum and minimum first reference threshold signals, each of said separate threshold comparator means receiving an associated one of said pair of maximum and minimum first threshold signals, said pair of first threshold signals causing said comparator means, via its output signals, said coupling means, said current sense means and said solenoid driver means, to implement pull-in maximum and minimum current limits for said solenoid current during said predetermined pull-in period of time; and holding current means coupled between said control input terminal and said comparator means for providing, for a hold time after said predetermined pull-in period of time, a pair of predetermined maximum and minimum second reference threshold signals, each of said separate threshold comparator means receiving an associated one of said second threshold signals during said hold time rather than said first threshold signals, wherein during said hold time said pair of second threshold signals define hold cycle maximum and minimum current limits for said solenoid current during said hold time.

2. A solenoid driver control circuit according to claim 1 wherein said switching threshold signals are fixed and independent of the magnitude of said solenoid current during said pull-in and hold periods of time.

3. A solenoid driver control circuit according to claim 2 wherein said maximum first threshold signals exceeds said maximum second threshold and wherein said minimum first threshold signal exceeds said minimum second threshold.

4. A solenoid driver control circuit according to claim 3 wherein each of said output signals provided by said two separate threshold comparator means are provided as effective set and reset inputs to a flip flop circuit, which is part of said coupling means, which provides an output signal to control said solenoid driver means.

5. A solenoid driver control circuit according to claim 4 wherein said pull-in current means includes a monostable multivibrator providing an output pulse of predetermined duration in response to receipt of said control signal.

6. A solenoid driver control circuit according to claim 5 wherein said monostable multivibrator output pulse is provided as an input to a resistor divider circuit which provides said first and second maximum and minimum reference threshold signals to each of said two separate threshold comparator means.

7. A solenoid driver control circuit according to claim 6 wherein said output of said flip flop circuit is coupled through an effective AND gate to said solenoid driver means and wherein said control signal is provided as an additional input to said AND gate.

8. A solenoid driver control circuit according to claim 1 wherein said maximum first threshold signals exceeds said maximum second threshold signal wherein said minimum first threshold exceeds said minimum second threshold signal.

9. A solenoid driver control circuit according to claim 8 wherein each of said output signals provided by said two separate threshold comparator means are provided as effective set and reset inputs to a flip flop circuit, which is part of said coupling means, which provides an output signal to control said solenoid driver means.

10. A solenoid driver control circuit according to claim 9 wherein said pull-in current means includes a monostable multivibrator providing an output pulse of predetermined duration in response to receipt of said control signal.

11. A solenoid driver control circuit according to claim 10 wherein said monostable multivibrator output pulse is provided as an input to a resistor divider circuit which provides said first and second maximum and minimum reference threshold signals to each of said two separate threshold comparator means.

12. A solenoid driver control circuit according to claim 11 wherein said output of said flip flop circuit is coupled through an effective AND gate to said solenoid driver means and wherein said control signal is provided as an additional input to said AND gate.

13. A solenoid driver control circuit according to claim 1 wherein said solenoid current varies cyclically between said pull-in maximum and minimum current limits during said pull-in time, and wherein said solenoid current varies cyclically between said hold cycle maximum and minimum current limits during said hold time.

14. A solenoid driver control circuit according to claim 2 wherein said solenoid current varies cyclically between said pull-in maximum and minimum current limits during said pull-in time, and wherein said solenoid current varies cyclically between said hold cycle maximum and minimum current limits during said hold time.

15. A solenoid driver control circuit according to claim 8 wherein said solenoid current varies cyclically between said pull-in maximum and minimum current limits during said pull-in time, and wherein said solenoid current varies cyclically between said hold cycle maximum and minimum current limits during said hold time.

* * * * *

UNITED STATES PATENT AND TRADEMARK OFFICE

CERTIFICATE OF CORRECTION

PATENT NO. : 4,764,840

DATED : Aug. 16, 1988

INVENTOR(S) : Adelore F. Petrie et al.

It is certified that error appears in the above-identified patent and that said Letters Patent is hereby corrected as shown below:

Claim 3, col. 8, line 24 delete "signals" and insert --signal--

Claim 3, col. 8, line 25 insert --signal-- after "threshold"

Claim 3, col. 8, line 26 add --signal-- after "threshold"

Claim 8, col. 8, line 51 delete "signals" and add --signal--

Claim 8, col. 8, line 52 add --and-- before "wherein"

Claim 8, col. 8, line 53 add --signal-- before "exceeds"

Signed and Sealed this

Tenth Day of December, 1991

*Attest:*

HARRY F. MANBECK, JR.

*Attesting Officer*

*Commissioner of Patents and Trademarks*